US006401835B1

(12) United States Patent
Scheid et al.

(10) Patent No.: US 6,401,835 B1
(45) Date of Patent: Jun. 11, 2002

(54) DRILLING TOOL

(75) Inventors: Winfried Scheid, Ebersbach; Gerhard Mutschler, Stuttgart, both of (DE)

(73) Assignee: DELMAG Maschinenfabrik (DE)

( * ) Notice: Subject to any disclaimer, the term of this patent is extended or adjusted under 35 U.S.C. 154(b) by 0 days.

(21) Appl. No.: 08/699,615

(22) Filed: Aug. 19, 1996

(30) Foreign Application Priority Data

Aug. 22, 1995 (DE) ..... 195 30 802

(51) Int. Cl.[7] ..... B23Q 5/00

(52) U.S. Cl. ..... 173/11; 173/104; 173/206; 173/213; 173/216

(58) Field of Search ..... 173/11, 104, 213, 173/218, 216, 221, 206, 4

(56) References Cited

U.S. PATENT DOCUMENTS

| | | | | | |
|---|---|---|---|---|---|
| 3,903,973 | A | * | 9/1975 | Leyrat et al. | 173/218 |
| 4,815,546 | A | * | 3/1989 | Haney et al. | 173/213 |
| 5,062,490 | A | * | 11/1991 | Rassieur | 173/104 |
| 5,064,003 | A | * | 11/1991 | Neroznikov et al. | 173/104 |
| 5,186,262 | A | * | 2/1993 | Thompson | 173/218 |
| 5,350,027 | A | * | 9/1994 | Mauch et al. | 173/216 |
| 5,524,713 | A | * | 6/1996 | Lange | 173/216 |

* cited by examiner

*Primary Examiner*—Scott A. Smith

(57) ABSTRACT

A drilling tool, the drill head (16) of which can be connected either to a drill (10) or a casing string (28), is also fitted with an automatic direction reversing mechanism (64) which is designed so that the driven part (14) of the drill head (60) executes backward and forward movements of less than 90°, but preferably 20° to 30°. In this way the drill head can also strike the casing string when sinking it.

10 Claims, 1 Drawing Sheet

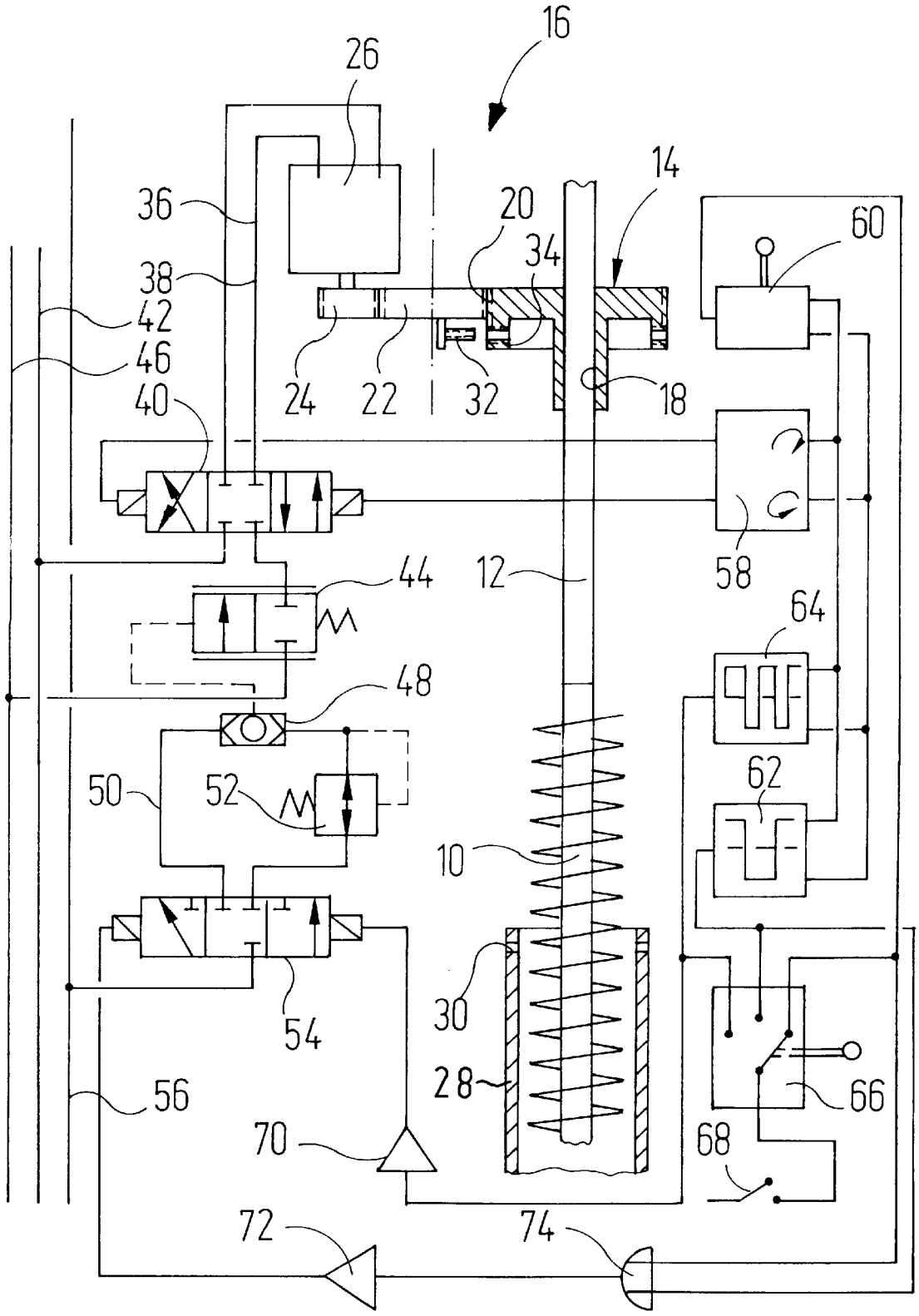
16
26
14
36
20
60
34
38
42
46
24
22
32
18
40
58
44
12
64
48
50
52
62
10
30
54
28
66
56
70
68
72
74

DRILLING TOOL

BACKGROUND OF THE INVENTION

The invention relates to a drilling tool.

A drilling tool is known having a drill head which has a driven part which can be connected either to a drilling string or to a casing string, comprising a reversing valve associated with a drive motor for the drill head, by means of which operating apertures in the drive motor can be connected either to a pressure line or to a return line in order to set the driven part in motion in either clockwise or anticlockwise rotation, and comprising a control unit associated with the reversing valve which has a manually operated direction change over switch.

Drilling tools of this type are used on those sites where a fairly small number of drill holes have to be made and where the earth first has to be loosened using a drill string and raised to the surface, and then the earth is prevented from sliding back into the drill hole by sinking a casing pipe string. Whereas on large sites where a large number of these drill holes have to be made a special casing machine is used to drive the casing pipe string into the ground, on small sites the drill head is used to rotate and sink the casing pipe string. It goes without saying that in this process a mechanical connection must be made between the driven part of the drill head and the casing pipe string or drill string depending upon the status of the work. The sinking of the casing pipe string is also achieved by using the drill head to rotate it in order to reduce the tensile loads being exerted.

The drill holes thus made are generally filled with concrete mixed on site which, once set, forms a foundation pile. In order to improve the load carrying capacity of the site-mixed concrete, reinforcing cages are set into it. If, with the drill hole filled with site-mixed concrete and with a reinforcing cage inserted, the casing pipe string is now sunk, using the drill head working on the drill string to rotate it, then by setting the casing pipe string to rotate constantly in the same direction, the concrete mass, and thus also the reinforcing cage which is set into it is finally set in rotation. Uncontrolled positional changes of the reinforcing cage may occur as a result.

This problem does not arise with the drilling tools used on large sites because the casing machines used there exert a backward and forward rotary motion on the casing pipe string (producing a directional effect on the casing pipe string).

SUMMARY OF THE INVENTION

The invention provides a drilling tool with a drill head which has a driven part which can be connected to either a drilling string or to a casing string, the drilling tool comprising a reversing valve associated with a drive motor for the drill head, by means of which operating apertures in the drive motor can be connected wither to a pressure line or to a return line in order to set the driven part in motion in either clockwise or anticlockwise rotation, and comprising a control unit associates with the reversing valve which has a manually operated direction change-over switch, in which the control unit has an automatic direction change-over switch, the output signals from which can be used in the same way as those of the manual direction change-over switch to control the reversing valve, the manual direction change-over switch and the automatic direction change-over switch can, as an option, be activated by an operating mode selector, and the direction change-over frequency at which the direction change-over switch operates can be adjusted to the speed of the drive motor so that the driven part executes an osciallating rotary movement with limited angular stroke.

It is now recognised that even on the more simple drilling tools according to the invention, any uncontrolled movement of the reinforcing cages inserted into the drill hole during the rotation-assisted sinking of the casing pipe string can be reduced by providing an automatic direction change-over switch, the switching frequency of which is selected to allow for the speed of rotation of the driving mechanism operating on the casing pipe string when sinking the casing pipe so that the aforesaid driving mechanism only executes limited oscillating angular movements.

The driving forces exerted by these rapid oscillating movements on the concrete in-fill become accentuated in time, with the result that no net torque or net forces are exerted even on the reinforcing cage inserted into the concrete.

This advantage is obtained at little additional cost because the provision of an automatic direction change-over switch does not involve the need for any expensive hydraulic power system parts. If a stored programmable control system is used to control the direction reversing valve, then automatic direction change-over can simply be achieved by means of an additional program block.

Preferably, the angular stroke of the driven part is less than 90° and is preferably between 20° and 30°.

The selection of the direction change-over frequency which leads to the angular strokes of this embodiment on the one hand considerably aids the sinking of the casing pipe string by rotating it, whilst on the other hand no net driving of the concrete occurs.

The ejecting of drillings from the drill tool can be very easily automated on a drilling tool according to the invention by providing yet another additional small measure over and above the direction change-over switch already provided; namely an additional automatic direction change-over switch which operates at an ejection change-over frequency which in practice is generally lower than the direction change-over frequency. To achieve change-over by means of a stored programmable control necessitates only an additional program block.

Whereas the frequency of the ejection direction change-over switch is selected so that in operation the drill string connected to the driven part of the drill head accelerates to full speed and then is suddenly braked in order to eject the earth contained in the drill helix, the operating frequency of the direction change-over switch is adjusted so that, allowing for the speed of the driven part of the drill head, only the comparatively small backward and forward movement of the casing pipe string as described is obtained.

Preferably, a controllable throttle is inserted into the pressure line leading to the reversing valve or into the return line leading to the reversing valve, and the servomotor for which is excited as a function of the output signal from the operating mode selector.

This further embodiment of the invention produces the effect that when the drill head is used to produce a direction effect on a casing pipe string, the operating speed of the driven part is also automatically reduced. This is also an advantage for producing a gentle directional effect.

Preferably, the servomotor for the controllable throttle is a pressure medium motor which can be connected to a control pressure source via a fluid OR element either directly or with the insertion of a pressure reducer.

According to this embodiment of the invention, the speed change-over of the drill head can be achieved very accurately and reliably.

Preferably, one input of the OR element is connected directly and the other input is connected via the pressure reducer to the two connections on the outlet side of a 3/2 pilot valve, but preferably a 3/3 pilot valve, the input of which is connected to the control pressure source, and the pilot valve is brought into the first operating position by two output signals from the operating mode selector which, are provided to set normal drilling mode with manual direction reverals or automatic reversal at the ejection change-over frequency and is put into the second operating position by a third output signal from the operating mode selector which is provided to set automatic reversal at direction change-over frequency.

Preferably, the drilling tool comprises a master control switch which can both start and stop the operation of all the direction change-over switches.

This embodiment allows the operators to stop the drill head or set it in motion in the same way in all operating modes of the drill head.

INTRODUCTION TO THE DRAWING

The invention is explained in greater detail using one example of an embodiment and by reference to the drawing. This drawing contains a single figure showing a schematic drawing of the major mechanical parts of a drilling tool and also an associated control mechanism.

DESCRIPTION OF PREFERRED EMBODIMENTS

In the drawing, a twist drill, designated with the number 10, is shown which is used to produce a drill hole in the ground. The twist drill 10 is connected to a drive rod 12 which may, for example, be square in cross-section and twist locking but which is carried in a driven part 14 of a drill head—the entire unit of which is designated with the number 16—in such a way that it has axial movement. The driven part 14 has a centre drive aperture 18 which is complementary in form to the cross-sectional form of the drive rod 12 and has an outside gear ring 12 which engages a hydraulic motor 26 with the driven pinion 24 via an intermediate pinion 22.

To support the wall of the drill hole produced by the twist drill 10 there is provided a casing pipe string 28 which consists of individual axial casing pipe sections lying one on top of the other and interconnected and in practice the twist drill 10 may also consist of individual interconnected drill sections.

The top end of the casing pipe string 28 has tappet holes 30 in it and in this way can be connected by means of cam studs 32 to a suspended drive wall 34 of the driven part 14, inside which the top end of the casing pipe string 28 can be held. In this way, the casing pipe string 28 can, as an option, also be driven by the hydraulic motor 26 in order to reduce the axial feed forces of the casing pipe string 28 being applied relative to the ground at high friction.

The hydraulic motor 26 can be either a clockwise rotating or an anticlockwise rotating motor. Its two operating apertures are connected via operating lines 36, 38 to the connection apertures on the outlet side of a reversing valve 40 which is shown as a 4/3 solenoid valve.

One is connected directly from the connection apertures on the inlet side of the reversing valve 40 to a return line 42. The other is connected via a controllable throttle 44, which is shown as a pilot operated 2/2 regulating valve to a pressure line 46 which is connected to a hydraulic pump on the drilling tool, not shown in the diagram.

The control connection of the controllable throttle 44 is connected via a two-way valve 48 forming a liquid OR element either directly (line 50) or via a pressure reducer 52 to the two outlets of a 3/3 solenoid valve 54, the inlet of which is connected to a control pressure line 46.

The operating magnets of the reversing valve 40 are actuated by means of a power amplifier 58 which, when a signal is supplied to a clockwise rotating control terminal, excites one operating magnet and, when a signal is supplied to an anticlockwise rotating control terminal, excites the other electromagnet of the reversing valve 40.

The control pulses supplied to the direction control terminals of the power amplifier 58 can alternatively be provided by three direction change-over switches, that is to say a first, manually operated direction change-over switch 60, a second direction change-over switch 62 operating at lower frequency and also a third direction change-over switch 64 operating at higher frequency.

Each of the direction change-over switches 60, 62, 64 has a control terminal and is only active when an activation signal is received on it.

An operating mode selector 66, which can be operated by the drilling tool operators provides an activation signal to each of its three outputs. In the embodiment illustrated this simply represents the through output signal of a master control switch 68 which is fitted in the operator's cab of the drilling tool. When the master control switch 68 is open none of the direction change-over switches 60, 62, 64 receives an activation signal, with the result that the change-over valve remains in its neutral centre position and the hydraulic motor 26 is therefore hydraulically blocked. By closing the master control switch 68 each of the direction change-over switches 60, 62, 64 activated by the operating mode selector 66 is free to operate.

In practice, the activation of the first direction change-over switch corresponds to normal drilling mode in which the operators control the drill (or the casing pipe string if connected to the driven part 14) under manual directional control.

The second direction change-over switch 62 is activated when earth is ejected by the twist drill 10. To achieve this the twist drill is accelerated to full speed by means of the second direction change-over switch 62 (e.g. positive half pulses of its output signal) and the earth is ejected from the drill by the rapid reversal of direction (negative half pulses of its output signal).

By activating the third direction change-over switch 64 the hydraulic motor 26 is only set in motion for short time intervals in both clockwise and anticlockwise rotation. These time intervals are calculated with respect to the speed of the hydraulic motor so that the angular movement of the driven part 14 represents a backward and forward movement with an angular stroke of 10° to 90°, but preferably 20° to 30°. This mode of operation is then set when the casing pipe string 28 is connected to the driven part 14 in order to sink the casing pipe. Under these conditions, a reinforcing cage is inserted into the casing pipe string and liquid, site-mixed concrete is poured in. The short-stroke rotating movements exerted on this when sinking the casing pipe string do not cause the concrete mass to execute by and large a net rotation and in so doing take the reinforcing cage with it.

The 3/3 solenoid valve is controlled in one operating position by means of a power amplifier 70 which is controlled by the output signal of the operating mode selector 66 associated with the direction change-over switch 64 which operates at high frequency and in the other operating position via a power amplifier 72 and an OR element 74, the two inputs of which are connected to the outputs of the operating mode selector 66 associated with first and second direction change-over switches.

By doing so, when the casing string 28 is struck, as it is to assist the sinking of the casing string, the hydraulic motor 26 is operated at lower speed than when drilling and when ejecting earth from the drill, because in the last two operations named the control aperture of the controllable throttle 44 is subjected to high control pressure, but it is subjected to low control pressure during change-over, with the result that in the latter instances the hydraulic motor 26 is supplied with less pressure medium.

To exert axial force on the drill and the casing pipe there are used long-stroke hydraulic rams which operate on the drill head and which are attached to a sledger carrying the drilling tool. These commonly known parts of the drilling tool are not illustrated in the drawing.

What is claimed is:

1. A drilling tool with a drill head which has a driven part connected to a drilling string or to a casing string, the drilling tool comprising a reversing valve associated with a drive motor for the drill head, by means of which operating ports in the drive motor are connected to a pressure line and to a return line in order to set the driven part in motion in clockwise and anticlockwise rotation respectively, and comprising a control unit associated with the reversing valve which has a manually operated direction change-over switch, in which the control unit has an automatic percussion direction change-over switch, the output signals from which being used in the same way as those of the manual direction change-over switch to control the reversing valve.

2. A drilling tool according to claim 1, in which the angular stroke of the driven part is less than 90°.

3. The drilling tool according to claim 2, in which the angular stroke of the driven part is between 20° and 30°.

4. A drilling tool according to claim 1, comprising an automatic drillings ejection-direction change-over switch working at a pre-set ejection-change-over frequency, the output signals from which control the change-over valve in the same way as that from the manual direction change-over switch and the direction change-over switch the operating mode selector being used to activate any one of the direction change-over switches as required.

5. A drilling tool according to claim 1, in which a controllable throttle is inserted into at least one of the pressure line leading to the reversing valve and the return line leading to the reversing valve, and a servomotor acting on the controllable throttle which is excited as a function of an output signal from an operating mode selector.

6. A drilling tool according to claim 5, in which the servomotor for the controllable throttle is a pressure medium motor which is connected to a control pressure source via a fluid OR element at least one of directly and with the insertion of a pressure reducer.

7. A drilling tool according to claim 6, in which one input of the OR element is connected directly and the other input is connected via the pressure reducer to two connections on an outlet side of a pilot valve, the input of which is connected to the control pressure source and the pilot valve is brought into a first operating position by two output signals from an operating mode selector which are provided to set normal drilling mode with one of manual direction reversal and automatic reversal at an ejection change-over frequency and is put into a second operating position by a third output signal from the operating mode selector which is provided to set automatic reversal at the change-over frequency.

8. The drilling tool according to claim 7, wherein the pilot valve comprises one of a 3/2 pilot valve and a 3/3 pilot valve.

9. A drilling tool according to claim 1, comprising a master control switch which starts and stops the operation of all the direction change-over switches.

10. The drilling tool according to claim 1, wherein a manual direction change-over switch and the automatic change-over switch are activated by an operating mode selector, and wherein a change-over frequency at which the direction change-over switch operates is adjusted to the speed of the drive motor so that the driven part executes an oscillating rotary movement with a limited angular stroke.

* * * * *